US011322885B2

(12) United States Patent
Osada et al.

(10) Patent No.: US 11,322,885 B2
(45) Date of Patent: May 3, 2022

(54) LEVER-TYPE CONNECTOR

(71) Applicant: Yazaki Corporation, Tokyo (JP)

(72) Inventors: Takeshi Osada, Shizuoka (JP); Takuya Hasegawa, Shizuoka (JP); Motoharu Nagakura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/081,539

(22) Filed: Oct. 27, 2020

(65) Prior Publication Data

US 2021/0135399 A1 May 6, 2021

(30) Foreign Application Priority Data

Oct. 31, 2019 (JP) ..... JP2019-198224

(51) Int. Cl.
*H01R 13/629* (2006.01)
*H01R 13/627* (2006.01)
*H01R 13/52* (2006.01)

(52) U.S. Cl.
CPC ..... *H01R 13/6272* (2013.01); *H01R 13/5202* (2013.01); *H01R 13/5208* (2013.01)

(58) Field of Classification Search
CPC ..... H01R 13/6272; H01R 13/5202; H01R 13/5208; H01R 13/5213; H01R 13/62955; H01R 13/62938; H01R 13/629; H01R 24/00
See application file for complete search history.

(56) References Cited

U.S. PATENT DOCUMENTS 6,439,902 B1 * 8/2002 Cole ..... H01R 13/62938 439/157
7,431,598 B2 * 10/2008 Ikeya ..... H01R 13/62938 439/160
7,794,247 B2 * 9/2010 Suzuki ..... H01R 13/62938 439/157
8,182,275 B2 * 5/2012 Suzuki ..... H01R 13/62933 439/157
8,235,744 B1 * 8/2012 Liptak ..... H01R 13/633 439/352
9,843,118 B1 * 12/2017 Tanaka ..... H01R 13/648
9,905,965 B2 * 2/2018 Tanaka ..... H01R 13/516
2003/0060078 A1 * 3/2003 Kashiyama ..... H01R 13/641 439/489

(Continued)

FOREIGN PATENT DOCUMENTS

JP 2018-041627 A 3/2018

*Primary Examiner* — Abdullah A Riyami
*Assistant Examiner* — Nelson R. Burgos-Guntin
(74) *Attorney, Agent, or Firm* — Sughrue Mion, PLLC

(57) ABSTRACT

A lever-type connector includes a housing, a lever and a cover. The housing is to be fitted with a mating housing. The lever is pivotably mounted to the housing and fits the housing with the mating housing by pivoting. The cover is mounted to the housing to cover an outer periphery of an electric cable drawn out from the housing. The housing is provide with a deflectable lock arm. The lock arm has as a base end, a root part integrally mounted to the housing at a side where the housing faces the cover and holds the lever at a pivoting completion position of the lever. The cover is provided with a protective wall arranged opposite to the root part of the lock arm.

2 Claims, 8 Drawing Sheets

(56) References Cited

U.S. PATENT DOCUMENTS

| | | | | |
|---|---|---|---|---|
| 2004/0266265 | A1* | 12/2004 | Hayashi | H01R 13/62933 439/607.53 |
| 2005/0136738 | A1* | 6/2005 | Wada | H01R 13/6585 439/607.43 |
| 2005/0282438 | A1* | 12/2005 | Wada | H01R 13/65912 174/359 |
| 2009/0023317 | A1* | 1/2009 | Mizoguchi | H01R 13/62938 439/157 |
| 2009/0075506 | A1* | 3/2009 | Suzuki | H01R 13/62955 439/157 |
| 2013/0065412 | A1* | 3/2013 | Ikeda | H01R 13/62938 439/157 |
| 2013/0228429 | A1* | 9/2013 | Henmi | H01R 13/62933 200/335 |
| 2013/0237078 | A1* | 9/2013 | Ikeda | H01R 13/62938 439/157 |
| 2015/0295352 | A1* | 10/2015 | Kim | H01R 13/62938 439/157 |
| 2016/0190738 | A9* | 6/2016 | Henmi | H01R 13/62938 439/157 |
| 2017/0229805 | A1 | 8/2017 | Yoshida | |
| 2018/0069346 | A1 | 4/2018 | Shimizu et al. | |
| 2021/0135399 | A1* | 5/2021 | Osada | H01R 13/62955 |

* cited by examiner

LEVER-TYPE CONNECTOR

CROSS-REFERENCE TO RELATED APPLICATION

The present application is based on, and claims priority from Japanese Patent Application No. 2019-198224, filed on Oct. 31, 2019, the entire contents of which are incorporated herein by reference.

TECHNICAL FIELD

The disclosure relates to a lever-type connector.

BACKGROUND

A conventional lever-type connector includes a housing and a lever. The housing can be fitted with a mating housing. The lever is pivotably mounted to the housing, and is configured to fit the housing with the mating housing by pivoting. There is also a lever-type connector with a cover mounted to the housing. The cover is configured to cover an outer periphery of an electric cable drawn out from the housing (see JP 2018-41627).

In the lever-type connector, the housing is provided with a deflectable lock member. The lock member has as a base end, a root part that is integrally mounted to the housing, and functions as a lock arm that holds the lever at a pivoting completion position of the lever.

Such a lever-type connector retains a fitting state of the housing and the mating housing by holding the lever at the pivoting completion position using the lock member.

SUMMARY

In the lever-type connector as described in JP 2018-41627, the root part of the lock arm, which is the base end (deflection support end) of the lock arm, is covered and protected with the lever at a pivoting initial position of the lever However, the root part of the lock arm is exposed to the outside at the pivoting completion position of the lever. Due to this, there is a possibility that an external force such as an interference with a peripheral member will be applied to the root part of the lock arm at the pivoting completion position.

It is concerned that a damage such as a plastic deformation or a fracture occurs in the root part of the lock arm when the external force is applied to the root part. If the damage occurs in the root part, the lock arm cannot hold the lever at the pivoting completion position. In this case, there is a possibility that the lever-type connector cannot retain the fitting state of the housing and the mating housing The disclosure has been made in view of such a conventional problem, and it is an object of the disclosure to provide a lever-type connector capable of stably retaining a fitting state of a housing and a mating housing.

According to an embodiment, there is provided a lever-type connector including: a housing to be fitted with a mating housing; a lever pivotably mounted to the housing and fitting the housing with the mating housing by pivoting; and a cover mounted to the housing to cover an outer periphery of an electric cable drawn out from the housing, wherein the housing is provide with a deflectable lock arm, the lock arm having as a base end, a root part integrally mounted to the housing at a side where the housing faces the cover and holding the lever at a pivoting completion position of the lever, and the cover is provided with a protective wall arranged opposite to the root part of the lock arm.

It is preferred that the cover is provided with an upper protective wall arranged opposite to the root part of the lock arm above the root part of the lock arm.

According to the embodiment, it is possible to provide a lever-type connector capable of stably retaining a fitting state of a housing and a mating housing.

DETAILED DESCRIPTION

Figure 1:
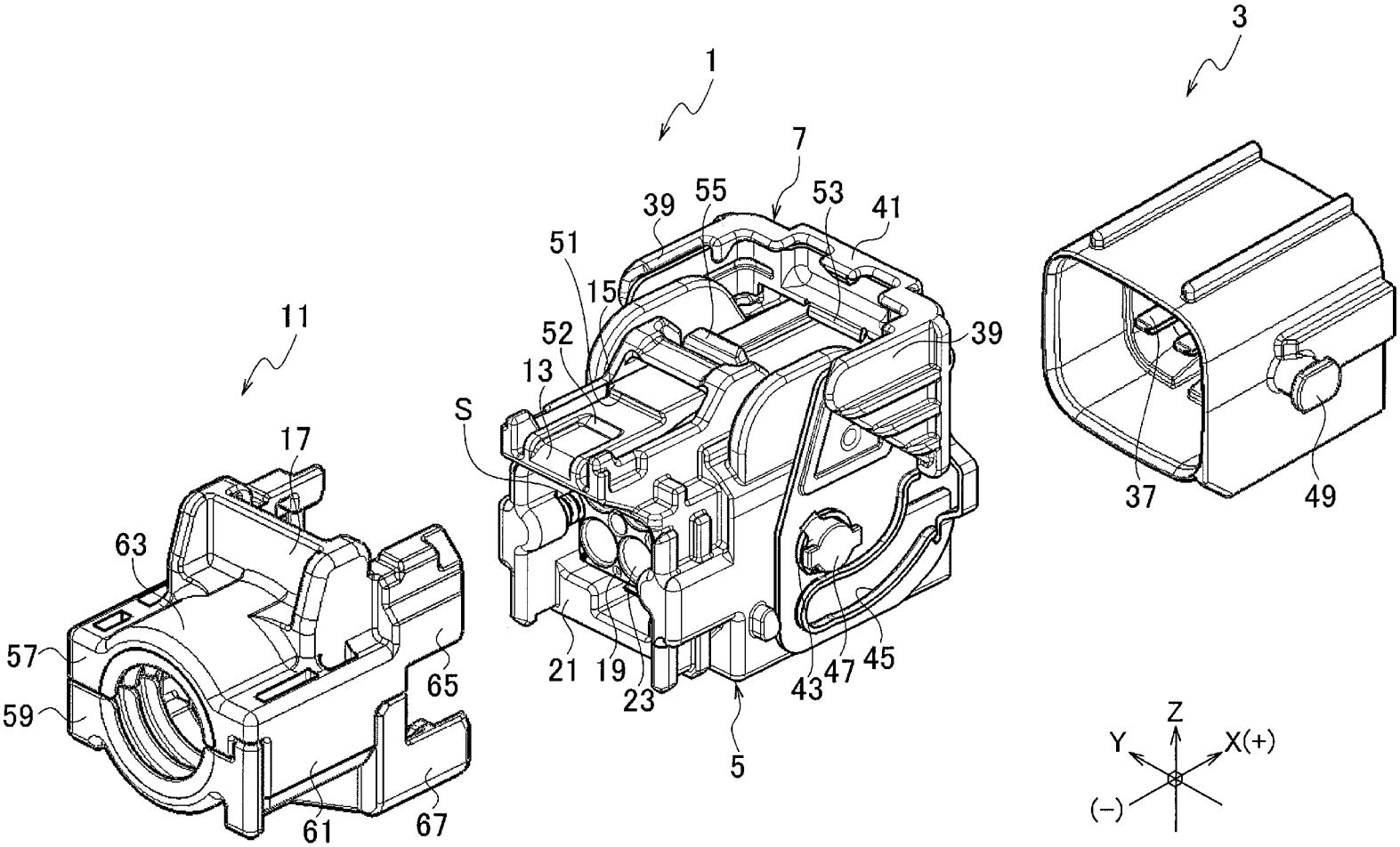
FIG. 1 is a disassembled perspective view of a lever-type connector according to a first embodiment of the disclosure.
Figure 2:
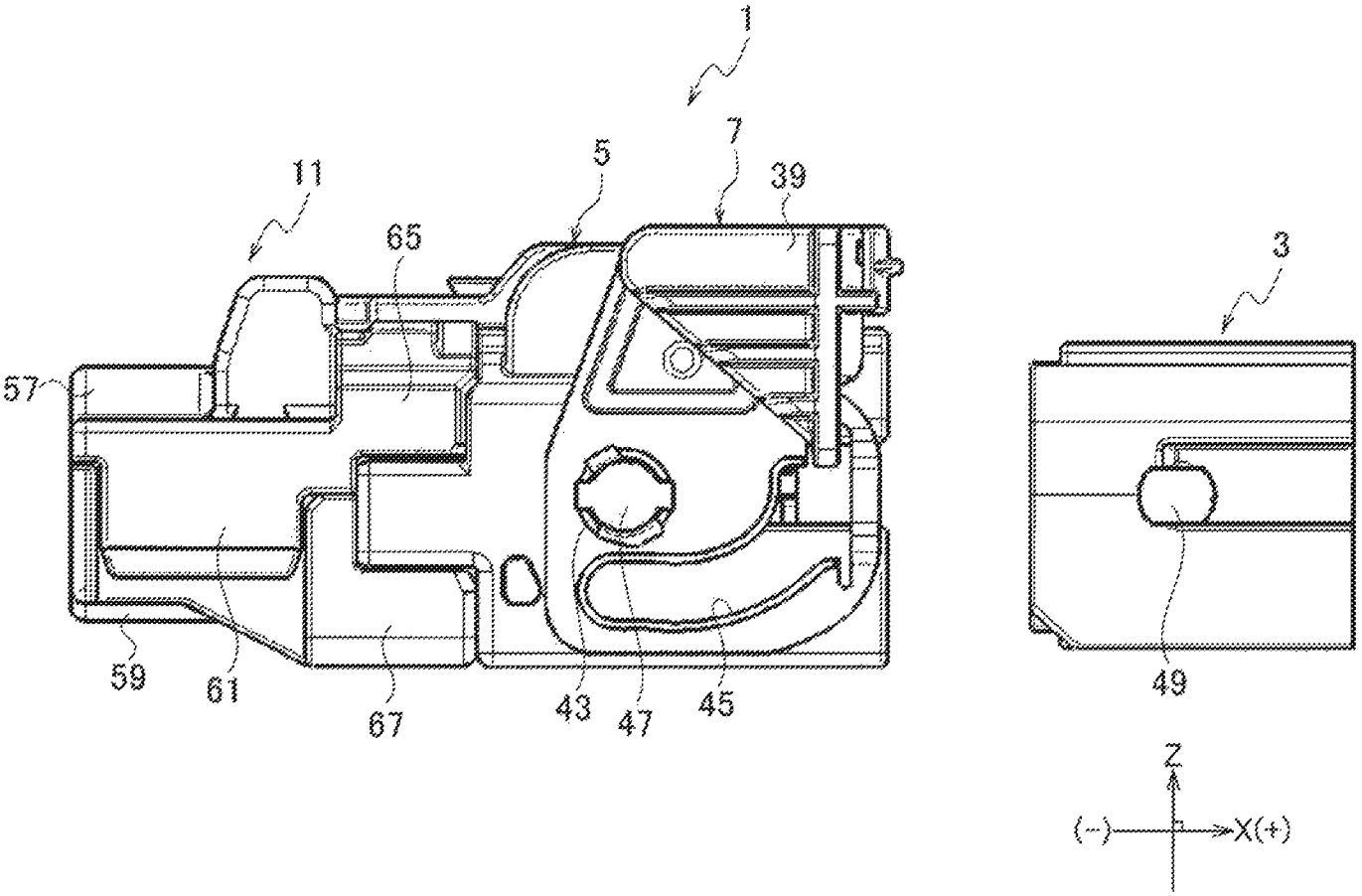
FIG. 2 is a side view illustrating a state before the lever-type connector according to the first embodiment is fitted with a mating housing.
Figure 3:
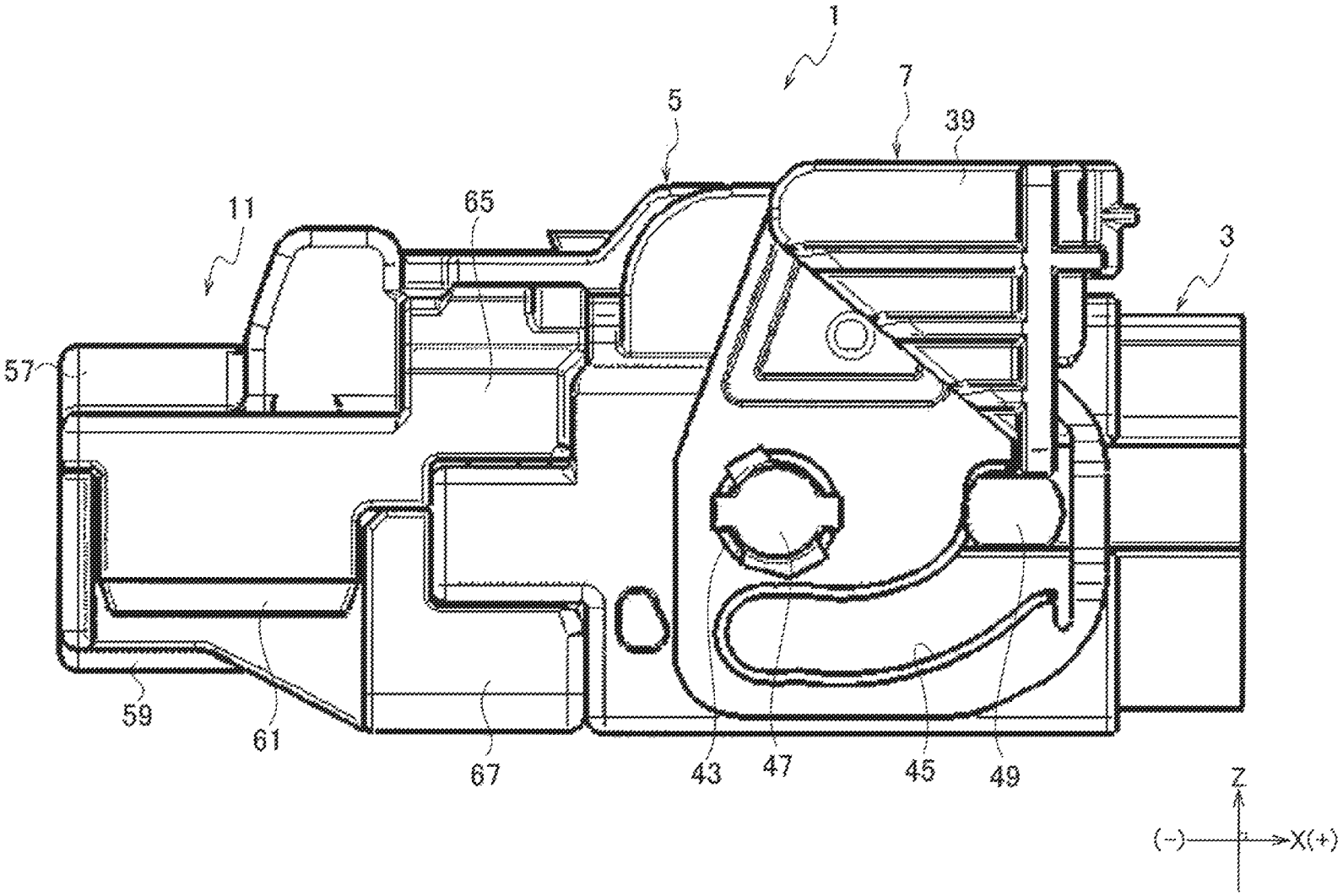
FIG. 3 is a side view illustrating a state where a lever of the lever-type connector according to the first embodiment is located at a pivoting initial position.
Figure 4:
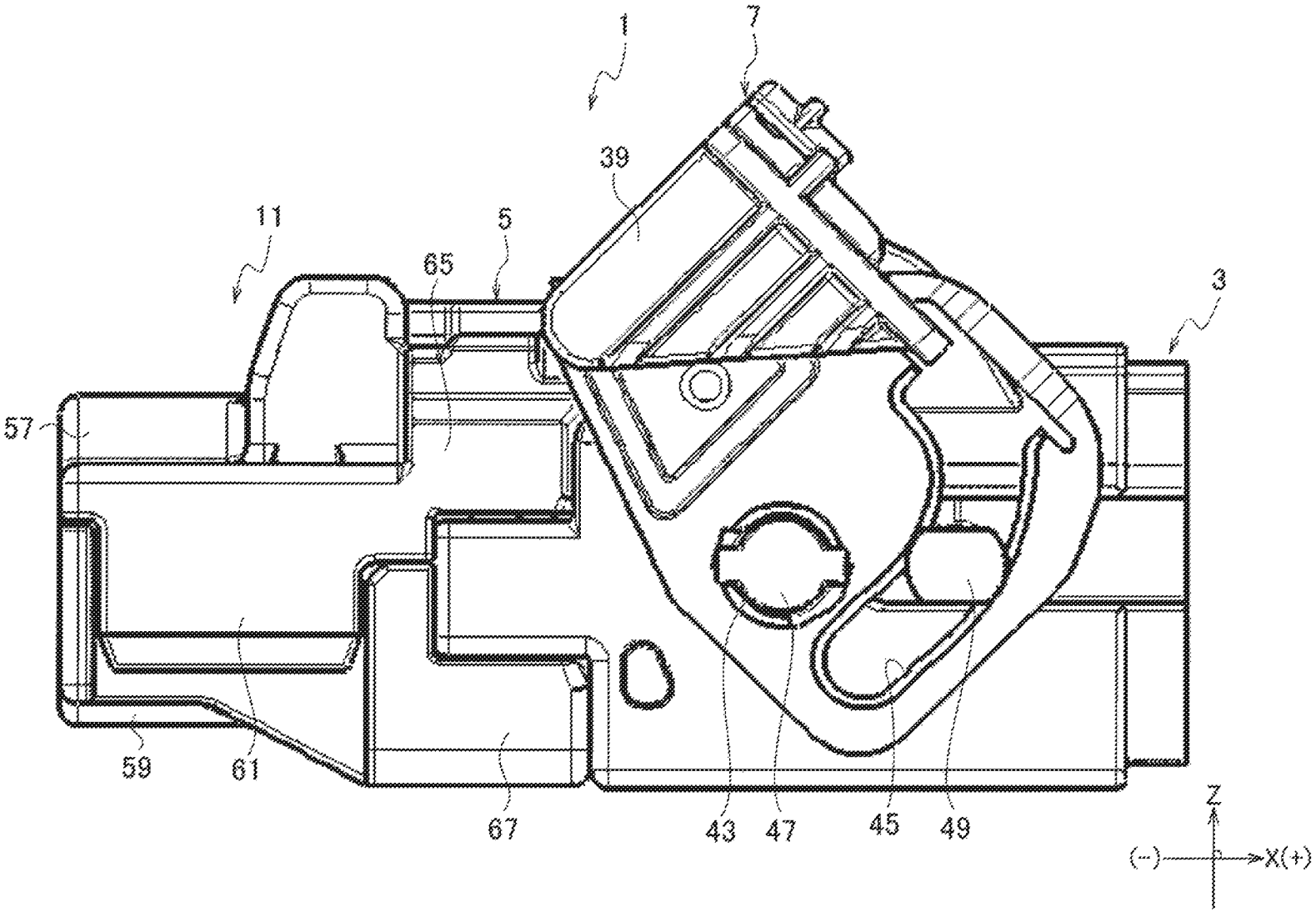
FIG. 4 is a side view illustrating a state where the lever of the lever-type connector according to the first embodiment pivots from the pivoting initial position.

A lever-type connector according to exemplary embodiments will be described in detail below with reference to drawings. Note that since a dimensional ratio of each element is exaggerated in the drawings for convenience of explanation, there is a case where the dimensional ratio in the drawings differs from an actual dimensional ratio.

First Embodiment

A first embodiment will be described with reference to FIG. 1 to FIG. 6. Note that in FIG. 1 to FIG. 6, an X-axis is defined as longitudinal directions of a mating housing 3, and a housing 5 and a cover 11 of a lever-type connector 1, a Y-axis is defined as width directions of the mating housing 3, the housing 5 and the cover 11, and a Z-axis is defined as height directions of the mating housing 3, the housing 5 and the cover 11. The X-axis, the Y-axis and the Z-axis are perpendicular to one another. In the lever-type connector 1, a side of the mating housing 3 in the housing 5 and a side of the housing 5 in the cover 11 are defined as +X side, and a side of the cover 11 in the housing 5 is defined as −X side.

The lever-type connector 1 according to the present embodiment includes the housing 5 and the lever 7. The housing 5 can be fitted with the mating housing 3. The lever 7 is pivotably mounted to the housing 5, and is configured to fit the housing 5 with the mating housing 3 by pivoting. The lever-type connector 1 also includes the cover 11 mounted to the housing 5. The cover 11 is configured to cover an outer periphery of an electric cable 9 drawn out from the housing 5.

The housing 5 is provided with a deflectable lock arm 15. The lock arm 15 has as a base end, a root part 13 that is integrally mounted to the housing 5 at a side (−X side) where the housing 5 faces the cover 11, and holds the lever 7 at a pivoting completion position of the lever 7.

The cover 11 is provided with a protective wall 17. The protective wall 17 is arranged opposite to the root part 13 of the lock arm 15. More specifically, the protective wall 17 is arranged opposite to a side surface of the root part 13.

As illustrated in FIG. 1 to FIG. 6, the housing 5 includes an inner housing 19 and an outer housing 21. The inner housing 19 is made of an insulating material such as a synthetic resin. The inner housing 19 is formed into a casing-like shape such that the inner housing 19 can be fitted to the mating housing 3. The inner housing 19 includes a plurality of terminal receiving chambers 23.

Each of the terminal receiving chambers 23 is extended in the inner housing 19, in a direction (X-axis direction) where the housing 5 is fitted with the mating housing 3. The terminal receiving chambers 23 are arranged in a line in a width direction (Y-axis direction) of the inner housing 19 and in a line a height direction (Z-axis direction) of the inner housing 19. In each of the terminal receiving chambers 23, a locking lance 25 is deflectably mounted.

The locking lance 25 is locked to a terminal 29 received in the corresponding terminal receiving chamber 23 to prevent the terminal 29 from coming off from the corresponding terminal receiving chamber 23. A regulating member 27 is inserted into a space within the corresponding terminal receiving chamber 23 formed in a deflection direction of the locking lance 25. In a state where the locking lance 25 is locked to the terminal 29, the regulating member 27 regulates a deflection of the locking lance 25.

Figure 5:
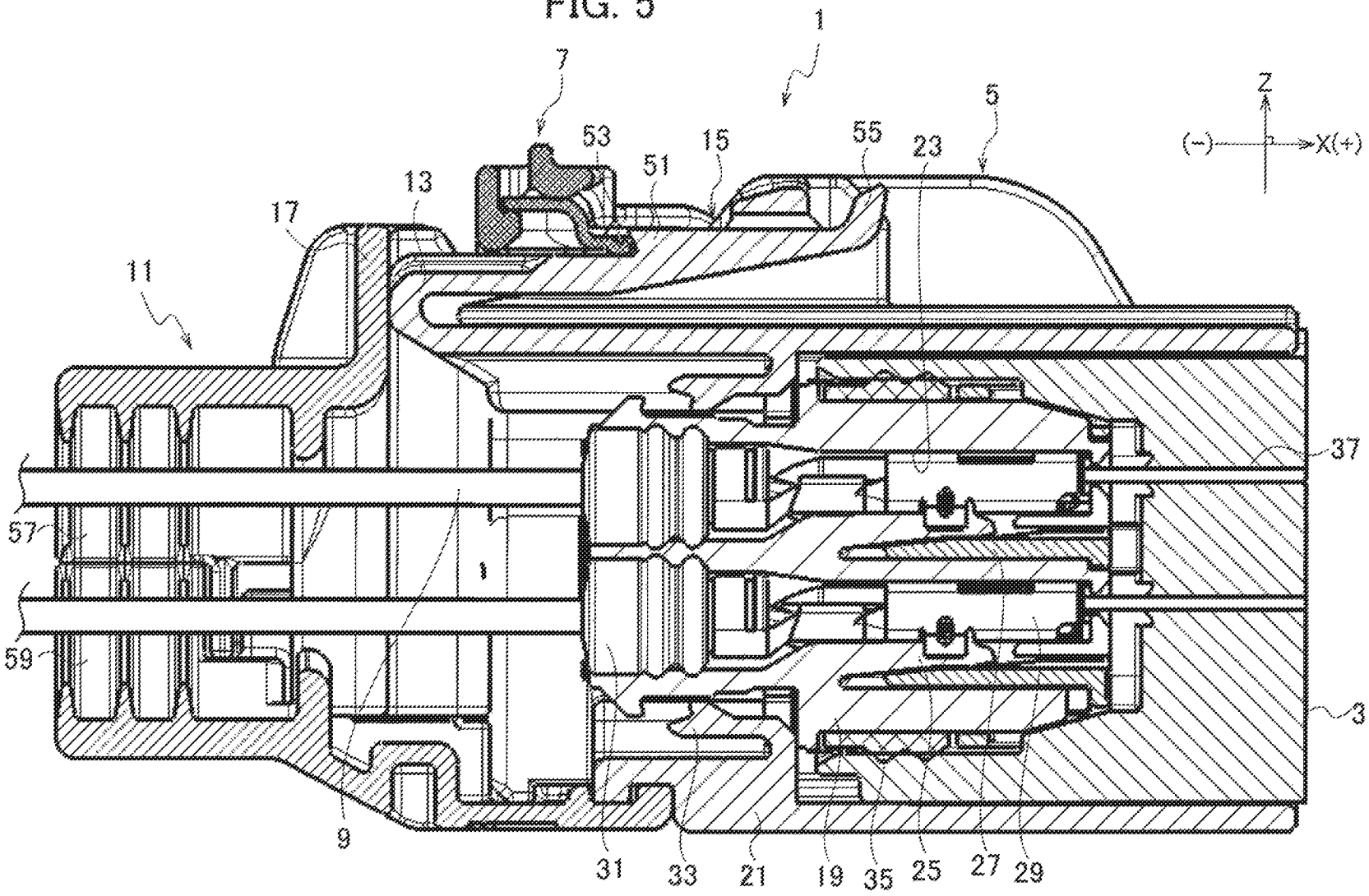
FIG. 5 is a cross-sectional view illustrating a state where the lever-type connector according to the first embodiment is fitted with the mating housing.
Figure 6:
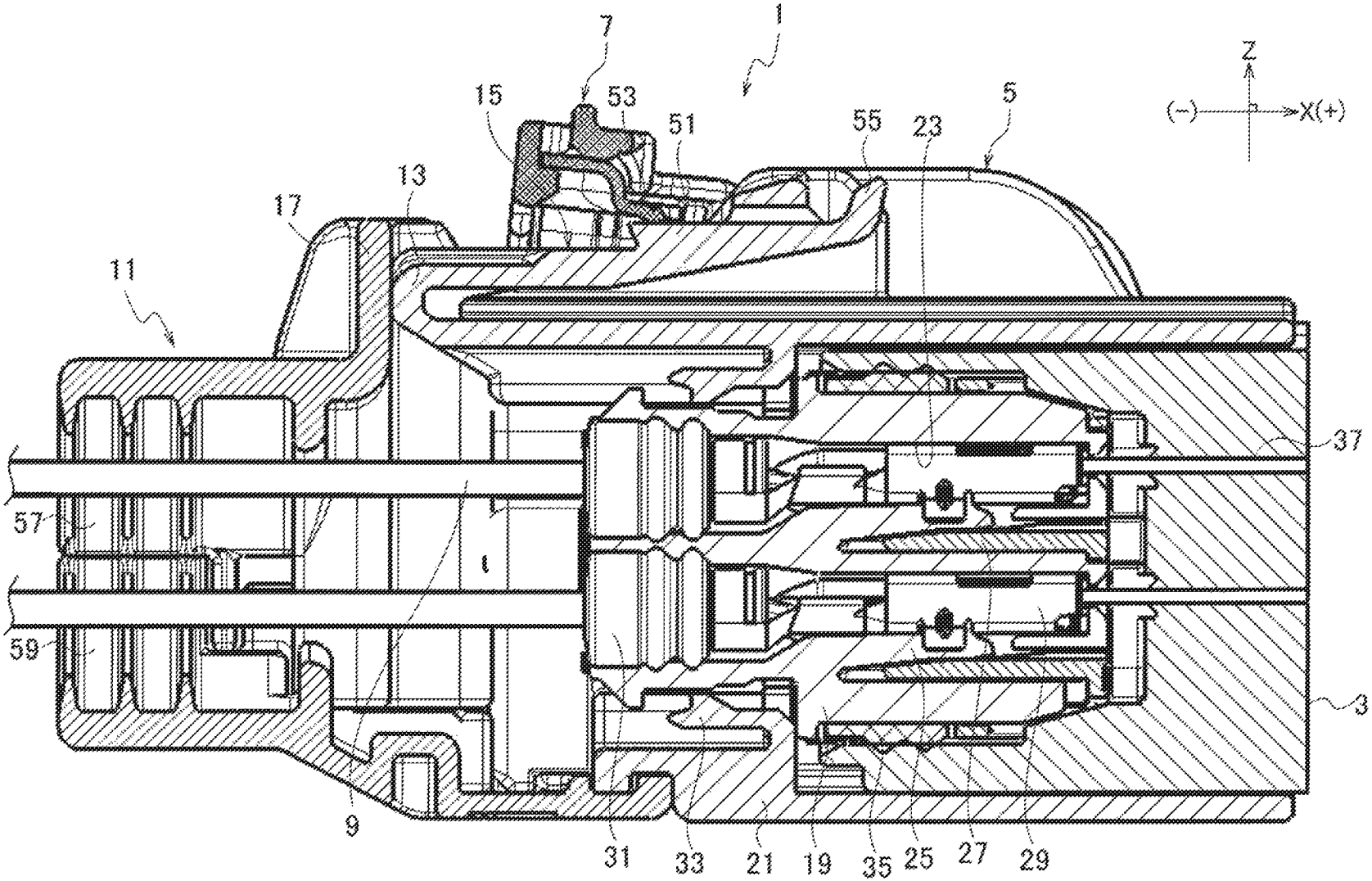
FIG. 6 is a cross-sectional view illustrating a state where holding of the lever by a lock arm of the lever-type connector according to the first embodiment is released.

As illustrated in FIG. 5 and FIG. 6, the terminal 29 is a female-type terminal having a connection part formed into a box-like shape. The terminal 29 is electrically connected to a terminal part of an electric cable 9. The electric cable 9 is electrically connected to a power source, a device or the like. In a state where the terminal 29 is electrically connected to the terminal part of the electric cable 9, the terminal 29 is introduced in the corresponding terminal receiving chamber 23 through an opening of the corresponding terminal receiving chamber 23, and then received in the corresponding terminal receiving chamber 23. In the corresponding terminal receiving chamber 23, the opening is formed at a side (−X side) opposite to a fitting surface of the inner housing 19 where the inner housing 19 is fitted to the mating housing 3.

In a state where the terminal 29 is received in the corresponding terminal receiving chamber 23, the electric cable 9 is drawn out to the outside of the housing 5 through the opening of the corresponding terminal receiving chamber 23 The electric cable 9 is provided with a rubber stopper 31. The rubber stopper 31 adheres to an outer periphery of the electric cable 9 and an inner periphery of the corresponding terminal receiving chamber 23, between the electric cable 9 and the corresponding terminal receiving chamber 23 to prevent water from entering the inner housing 19.

As illustrated in FIG. 1 to FIG. 6, the outer housing 21 is made of an insulating material such as a synthetic resin. The outer housing 21 can accommodate the inner housing 19. The outer housing 21 is formed into a casing-like shape such that the mating housing 3 can be inserted in the outer housing 21. The outer housing 21 accommodates the inner housing 19 and holds the inner housing 19 by using a locking part 33 deflectably mounted to the outer housing 21. A spring S intervenes between the outer housing 21 and the inner housing 19 and allows the outer housing 21 and the inner housing 19 to relatively slide.

A packing 35 is arranged between the outer housing 21 and the inner housing 19. The packing 35 prevents water from entering between the outer housing 21 and the inner housing 19. In a state where the outer housing 21 accommodates the inner housing 19, the mating housing 3 is inserted in the outer housing 21 to be fitted to the inner housing 19.

As illustrated in FIG. 1 to FIG. 6, the mating housing 3 is made of an insulating material such as a synthetic resin. The mating housing 3 is formed into a casing-like shape such that the mating housing 3 can be inserted in the outer housing 21 and the inner housing 19 can be fitted to the mating housing 3 within the mating housing 3. In the mating housing 3, a plurality of mating terminals 37 is received. Each of the mating terminals 37 is a male-type terminal having a connection part formed into a tab shape by an insert molding, a press fitting or the like.

The mating housing 3 is fitted with the inner housing 19 such that each of the mating terminals 37 is electrically connected to the corresponding terminal 29 in the corresponding terminal receiving chamber 23. Such a fitting of the mating housing 3 and the housing 5 is performed by pivoting of the lever 7 pivotably mounted to the housing 5.

As illustrated in FIG. 1 to FIG. 6, the lever 7 is mainly made of a metal material. For example, parts made of an insulating material such as a synthetic resin, are mounted to a part of each of sidewalls 39, 39 and a part of a linking part 41 of the lever 7. Note that the lever 7 may be made of only an insulating material such as a synthetic resin. The lever 7 includes a pair of the sidewalls 39, 39 and the linking part 41 linking the sidewalls 39, 39 to each other. The lever 7 is formed to have a width larger than that of the housing 5 by the sidewalls 39, 39 and the linking part 41. The lever 7 is provided with shaft holes 43, 43 and cam grooves 45, 45.

The shaft holes 43, 43 penetrate the sidewalls 39, 39 of the lever 7 respectively. Shaft parts 47, 47 projected from both side surfaces of the outer housing 21, are engaged to the shaft holes 43, 43. By such an engaging of the shaft parts 47, 47 and the shaft holes 43, 43, the lever 7 is pivotably mounted to the outer periphery of the housing 5.

The cam grooves 45, 45 penetrate the sidewalls 39, 39 of the lever 7 respectively. Each of the cam grooves 45, 45 opens at a side of a fitting surface (+X side) of the housing 5 where the housing 5 is fitted with the mating housing 3. When the housing 5 starts to be fitted with the mating housing 3, cam pins 49, 49 projected from both side surfaces of the mating housing 3, are respectively inserted in the cam grooves 45, 45 from the openings of the cam grooves 45, 45, by pivoting of the lever 7.

In a state where the housing 5 is fitted with the mating housing 3, the lever 7 can pivot between the pivoting initial position (see FIG. 3) and the pivoting completion position (see FIG. 5). When the lever 7 pivots from the pivoting initial position toward the pivoting completion position, the cam pins 49, 49 of the mating housing 3 are respectively inserted in the cam grooves 45, 45 of the lever 7.

In this state, when the lever 7 pivots to the pivoting completion position, the cam pins 49, 49 move along the cam grooves 45, 45 and pull the mating housing 3 in the housing 5 to fit the mating housing 3 to the housing 5. By the fitting of the mating housing 3 and the housing 5, each of the mating terminals 37 is electrically connected to the corresponding terminal 29 in the corresponding terminal receiving chamber 23. At the pivoting completion position, the lock arm 15 mounted to the housing 5, holds the pivoting position of the lever 7.

The lock arm 15 is deflectably mounted to the housing 5. The lock arm 15 has as the base end, the root part 13 that is formed by a single member continuously connected to the housing 5, at a side (−X side) where the cover 11 is mounted to the housing 5, on an upper surface of the housing 5. An engaging part 51 is formed in a stepped shape near the center of the lock arm 15. The engaging part 51 is engaged with an engaged part 53 mounted to the linking part 41 of the lever 7 at the pivoting completion position of the lever 7. By the engagement of the engaging part 51 and the engaged part 53, the lever 7 is held at the pivoting completion position of the lever 7 to retain the fitting state of the mating housing 3 and the housing 5.

A recessed part 52 is formed at a side of the root part 13 (−X side) in the lock arm 15 (see FIG. 1). The recessed part 52 has an opened upper surface and an opened rear surface. An upper surface of the root part 13 is continuously connected to a bottom surface of the recessed part 52.

A release operation part 55 is mounted to the lock arm 15 at a side of a free end (+X side) of the lock arm 15. When the release operation part 55 is pressed downward, the release operation part 55 deflects the lock arm 15 downward. By the deflection of the lock arm 15, the engagement of the engaging part 51 and the engaged part 53 is released (see FIG. 6). When the engagement of the engaging part 51 and the engaged part 53 is released, the lever can pivot from the pivoting completion position toward the pivoting initial position.

When the lever 7 pivots from the pivoting completion position toward the pivoting initial position, the cam pins 49, 49 move along the cam grooves 45, 45 to release the fitting of the mating housing 3 and the housing 5. The cover 11 is mounted to the housing 5 at a side of the root part 13 (−X side) of the lock arm 15.

As illustrated in FIG. 1 to FIG. 6, the cover 11 is made of an insulating material such as a synthetic resin, and includes an upper cover part 57 and a lower cover part 59. The upper cover part 57 is provided with engaging parts 61, 61 on both sidewalls of the upper cover part 57. By engaging the engaging parts 61, 61 to the lower cover part 59, the upper cover part 57 and the lower cover part 59 are assembled in a unified manner. The upper cover part 57 and the lower cover part 59 are respectively provided with electric cable leading parts 63, 63 each of which is formed into a semicircular shape. In a state where the upper cover part 57 and the lower cover part 59 are assembled in a unified manner and the cover 11 is mounted to the housing 5, the electric cable 9 drawn out from the housing 5 is inserted in a space surround by the electric cable leading parts 63, 63.

The upper cover part 57 and the lower cover part 59 are respectively provided with engaging parts 65, 67. By engaging the engaging parts 65, 67 to the housing 5, the cover 11 is mounted to the housing 5 in a unified manner. Since the cover 11 configured to cover the electric cable 9 drawn out from the housing 5, is divided the upper cover part 57 and the lower cover part 59, the cover 11 is easily mounted to the housing 5. The upper cover part 57 of the cover 11 is provided with a protective wall 17 at a side of the lock arm 15 (+X side) in the cover 11.

The protective wall 17 is formed by a single member continuously connected to the upper cover part 57 and stands upward on an upper surface of the upper cover part 57. In a state where the cover 11 is mounted to the housing 5, the protective wall 17 is arranged opposite to the root part 13 of the lock arm 15. By arranging the protective wall 17 such that the protective wall 17 faces the root part 13 of the lock arm 15, the electric cable 9 drawn out from the housing 5, a peripheral member or the like can be prevented from interfering with the root part 13.

As described above, by protecting the root part 13 of the lock arm 15 using the protective wall 17, it is possible to prevent the root part 13 from being damaged due to an external force. Due to this, the lock arm 15 can stably hold the lever 7 at the pivoting completion position, which stably retains a fitting state of the mating housing 3 and the housing 5.

Thus, in the lever-type connector 1, since the cover 11 is provided with the protective wall 17 arranged opposite to the root part 13 of the lock arm 15, it is possible to prevent an external force from being applied to the root part 13 using the protective wall 17. This prevents the occurrence of damage in the root part 13 of the lock arm 15.

Therefore, the lever-type connector 1 can stably hold the lever 7 at the pivoting completion position using the lock arm 15, which stably retains a fitting state of the mating housing 3 and the housing 5.

Second Embodiment

A second embodiment will be described with reference to FIG. 7 and FIG. 8. Note that in FIG. 7 and FIG. 8, an X-axis is defined as the longitudinal directions of the mating housing 3, and the housing 5 and the cover 11 of a lever-type connector 101, a Y-axis is defined as the width directions of the mating housing 3, the housing 5 and the cover 11, and the Z-axis is defined as the height directions of the mating housing 3, the housing 5 and the cover 11. The X-axis, the Y-axis and the Z-axis are perpendicular to one another. In the lever-type connector 101, a side of the mating housing 3 in the housing 5 and a side of the housing 5 in the cover 11 are defined as +X side, and a side of the cover 11 in the housing 5 is defined as −X side.

In the lever-type connector 101 according to the present embodiment, the cover 11 is provided with an upper protective wall 103 arranged opposite to the root part 13 of the lock arm 15 above the root part 13 of the lock arm 15. More specifically, the upper protective wall 103 is arranged opposite to the upper surface of the root part 13.

Note that the same reference numerals are given to the same components as those of the lever-type connector 1 according to the first embodiment. Although description of the same components as those of the lever-type connector 1 is omitted, these components have the same effects as those of the lever-type connector 1.

Figure 7:
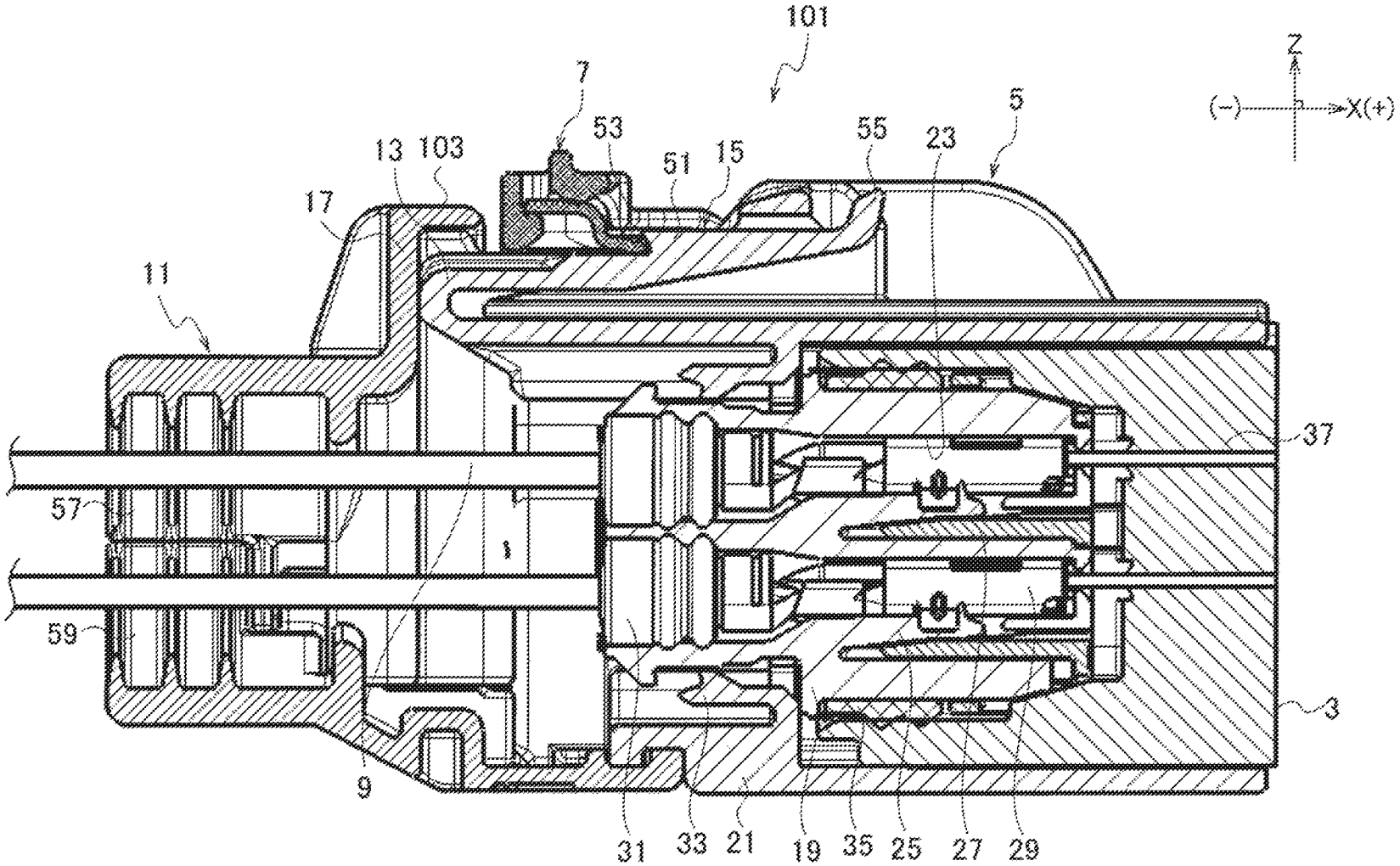
FIG. 7 is a cross-sectional view illustrating a state where a lever-type connector according to a second embodiment is fitted with the mating housing.
Figure 8:
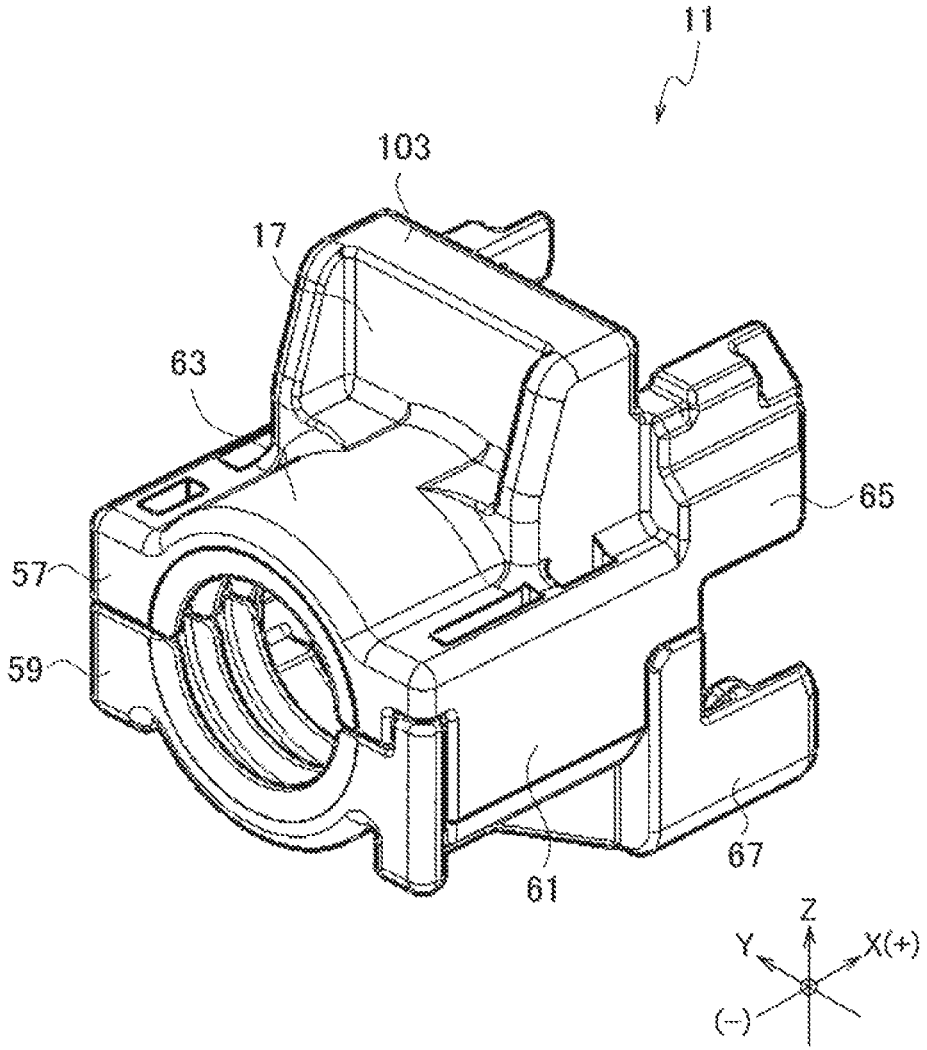
FIG. 8 is a perspective view of a cover of the lever-type connector according to the second embodiment.

As illustrated in FIG. 7 and FIG. 8, the upper cover part 57 of the cover 11 is provided with the upper protective wall 103. The upper protective wall 103 is formed by a single member continuously connected to the protective wall 17. The upper protective wall 103 extends toward a side of the housing 5 (+X side) from an upper end of the protective wall 17. In a state where the cover 11 is mounted to the housing 5, the upper protective wall 103 is arranged opposite to the root part 13 of the lock arm 15 above the root part 13 of the lock arm 15.

By arranging the upper protective wall 103 such that the upper protective wall 103 faces the root part 13 of the lock arm 15 above the root part 13 of the lock arm 15, it is possible to protect the root part 13 of the lock arm 15 using the protective wall 17 and the upper protective wall 103. Due to this, the electric cable 9 drawn out from the housing 5, a peripheral member or the like can be further prevented from interfering with the root part 13.

In the lever-type connector 101, since the cover 11 is provided with the upper protective wall 103 arranged opposite to the root part 13 of the lock arm 15 above the root part 13 of the lock arm 15, it is possible to prevent an external force from being applied to the root part 13 using the protective wall 17 and the upper protective wall 103. This further prevents the occurrence of damage in the root part 13 of the lock arm 15.

Although the present embodiments has been described above, the disclosure is not limited to the present embodiment, and various modifications can be made.

Although the upper protective wall 103 is integrally mounted to the protective wall 17 and extends from an upper end of the protective wall 17 in the second embodiment, the disclosure is not limited to this. The upper protective wall 103 may be extend from another part of the protective wall 17. Although the upper protective wall 103 is formed by a single member continuously connected to the protective wall 17, the disclosure is not limited this. The upper protective wall 103 may be formed by a member independent of the protective wall 17. For example, the upper protective wall 103 may extend from a different position from the position where the protective wall 17 is provided, in the cover 11.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lever-type connector comprising:

a housing to be fitted with a mating housing;

a lever pivotably mounted to the housing and fitting the housing with the mating housing by pivoting; and a cover mounted to the housing to cover an outer periphery of an electric cable drawn out from the housing, wherein the housing is provided with a deflectable lock arm, the lock arm having as a base end, a root part integrally mounted to the housing at a side where the housing faces the cover and holding the lever at a pivoting completion position of the lever, and the cover is provided with a protective wall arranged opposite to the root part of the lock arm.

2. The lever-type connector according to claim 1, wherein the cover is provided with an upper protective wall arranged opposite to the root part of the lock arm above the root part of the lock arm.

* * * * *